US008258435B2

(12) United States Patent
Bonuso et al.

(10) Patent No.: US 8,258,435 B2
(45) Date of Patent: Sep. 4, 2012

(54) DUAL FAN CONVECTION OVEN

(75) Inventors: Jennifer L. Bonuso, Saint Joseph, MI (US); Steven M. Swayne, Chattanooga, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 749 days.

(21) Appl. No.: 12/335,864

(22) Filed: Dec. 16, 2008

(65) Prior Publication Data

US 2010/0147280 A1 Jun. 17, 2010

(51) Int. Cl.
*A21B 1/26* (2006.01)
*F24C 15/32* (2006.01)

(52) U.S. Cl. ..... 219/400; 126/21 A; 99/475

(58) Field of Classification Search ..... None
See application file for complete search history.

(56) References Cited

U.S. PATENT DOCUMENTS

| | | | | |
|---|---|---|---|---|
| 4,029,463 | A | 6/1977 | Johansson et al. | |
| 4,467,777 | A | 8/1984 | Weber | |
| 5,165,889 | A | 11/1992 | Baggott | |
| 5,235,962 | A * | 8/1993 | Doty et al. | 126/21 A |
| 5,460,158 | A | 10/1995 | Rigaud | |
| 6,545,251 | B2 | 4/2003 | Allera et al. | |
| 6,766,796 | B2 | 7/2004 | Franzolin et al. | |
| 6,854,457 | B2 | 2/2005 | Rabas et al. | |
| 6,943,321 | B2 | 9/2005 | Carbone et al. | |
| 7,102,105 | B2 | 9/2006 | Oh | |
| 7,282,673 | B2 * | 10/2007 | Sung et al. | 219/400 |
| 7,686,009 | B2 * | 3/2010 | Park et al. | 126/190 |
| 7,992,552 | B2 * | 8/2011 | Hirano et al. | 126/21 A |
| 8,049,142 | B2 * | 11/2011 | Blackson et al. | 219/398 |
| 2004/0040950 | A1 * | 3/2004 | Carbone et al. | 219/400 |
| 2004/0200362 | A1 | 10/2004 | Leppich et al. | |
| 2005/0092314 | A1 | 5/2005 | Rabas et al. | |
| 2005/0139202 | A1 | 6/2005 | Herbert | |
| 2005/0139588 | A1 * | 6/2005 | Kim | 219/400 |
| 2006/0006163 | A1 | 1/2006 | Carbone et al. | |
| 2006/0011607 | A1 * | 1/2006 | Cho et al. | 219/401 |
| 2006/0027560 | A1 | 2/2006 | Song et al. | |
| 2006/0131298 | A1 * | 6/2006 | Seuk Oh | 219/400 |
| 2006/0137675 | A1 * | 6/2006 | Kim et al. | 126/21 A |
| 2006/0225727 | A1 | 10/2006 | Kim et al. | |

(Continued)

FOREIGN PATENT DOCUMENTS

EP 0401173 A2 12/1990

(Continued)

OTHER PUBLICATIONS

KR10-2006-0118686, Choi, Apr. 2008, partial translation.*

*Primary Examiner* — Joseph M Pelham
(74) *Attorney, Agent, or Firm* — Jason S. Burnette; Diederiks & Whitelaw PLC

(57) ABSTRACT

A combination convection and radiant cooking appliance includes an oven cavity, broil and bake radiant heating elements, a convection cover defining a rear wall of the oven cavity, a back panel, and a dual fan convection heating system mounted between the convection cover and the back panel. Each combination fan/heater of the dual convection heating system includes a multi-speed fan and an associated electric heating element, with the fans being vertically disposed in the oven cavity. Controls are provided to enable a user to select between at least a bake mode, a no preheat convection bake mode, a rapid preheat convection bake mode, a preheat convection bake mode and a convection roast mode.

13 Claims, 2 Drawing Sheets

U.S. PATENT DOCUMENTS

2006/0289436 A1* 12/2006 Carbone et al. ..... 219/400
2007/0095813 A1* 5/2007 Sung et al. ..... 219/400
2008/0202354 A1* 8/2008 Lee et al. ..... 99/476
2008/0237212 A1* 10/2008 Blackson et al. ..... 219/398
2009/0050619 A1* 2/2009 Yang et al. ..... 219/400
2010/0006085 A1* 1/2010 Thomas et al. ..... 126/21 A
2010/0012644 A1* 1/2010 Phillips et al. ..... 219/400
2010/0147824 A1* 6/2010 Bonuso et al. ..... 219/400
2010/0147825 A1* 6/2010 Bonuso et al. ..... 219/400
2010/0198410 A1* 8/2010 Choi et al. ..... 700/275
2010/0282731 A1* 11/2010 Jeong et al. ..... 219/400

FOREIGN PATENT DOCUMENTS

GB 2090967 A 7/1982
KR 10-2006-0118686 * 4/2008

* cited by examiner

DUAL FAN CONVECTION OVEN

BACKGROUND OF THE INVENTION

1. Field of the Invention

The present invention pertains to the art of cooking and, more particularly, to the construction of a dual fan convection oven.

2. Description of the Related Art

In general, conventional ovens employ radiant heating elements, such as bake and broil elements, to cook food within an oven cavity. However, due mainly to consumer demands for ovens which can cook a meal in less time than conventional ovens without sacrificing the quality of the prepared food, conventional cooking techniques are continually being combined with other cooking systems. For instance, in seeking to meet consumer demands, manufacturers are combining conventional radiant cooking systems with convection, microwave and other types of rapid cooking systems.

Problems connected with designing an oven capable of rapidly and effectively cooking a food item are exacerbated by the wide array of consumer tastes. Simply stated, no single cooking process lends itself to efficiently and effectively cooking the wide variety of food items desired by consumers. However, it is considered that convection ovens show significant versatility in connection with providing a wide range in the types of cooking operations which can be effectively performed. For instance, forced air convection allows for cooking at lower temperatures as compared to conventional radiant cooking processes, while still reducing overall cook time and increasing product quality. Basically, forced air streams are created to disrupt a thermal insulation layer about a food item which, in turn, increases the heat transfer rate between the food item and its surroundings. Further enhancements are found when utilizing a convection system in conjunction with a conventional radiant heating system.

It is considered that an oven design incorporating a forced air convection system capable of performing both convection and standard radiant cooking can enable an appetizing meal to be prepared in a short time period. The prior art has many examples of ovens which combine several types of cooking processes. However, in connection with combination convection and standard radiant cooking appliances, most are limited to the use of a single fan. In addition, even in connection with ovens employing multiple convection fans, drawbacks are seen to exist in connection with the overall construction, including the efficient positioning of the fans, the ease of assembly and the accessibility of components in case servicing is required. To address these concerns, it is seen to be desirable to provide a combination oven which provides the advantages of both convection and conventional cooking techniques, while being efficiently and effectively constructed.

SUMMARY OF THE INVENTION

The present invention is directed to a combination convection and radiant cooking appliance in the form of an oven including an oven cavity, broil and bake radiant heating elements, a convection cover defining a rear wall of the oven cavity, a back panel, and a dual fan convection heating system mounted between the convection cover and the back panel. Each combination fan/heater of the dual convection heating system includes a multi-speed fan and an independent electric heating element, with the fans being vertically disposed in the oven cavity. An interface is provided to enable a user to select between at least a bake mode, a no preheat convection bake mode, a rapid preheat convection bake mode, a preheat convection bake mode and a convection roast mode, and a controller is placed in communication with the user interface for controlling operation of the broil element, the bake element, the convection heaters, and the convection fans.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF PREFERRED EMBODIMENT

Figure 1:
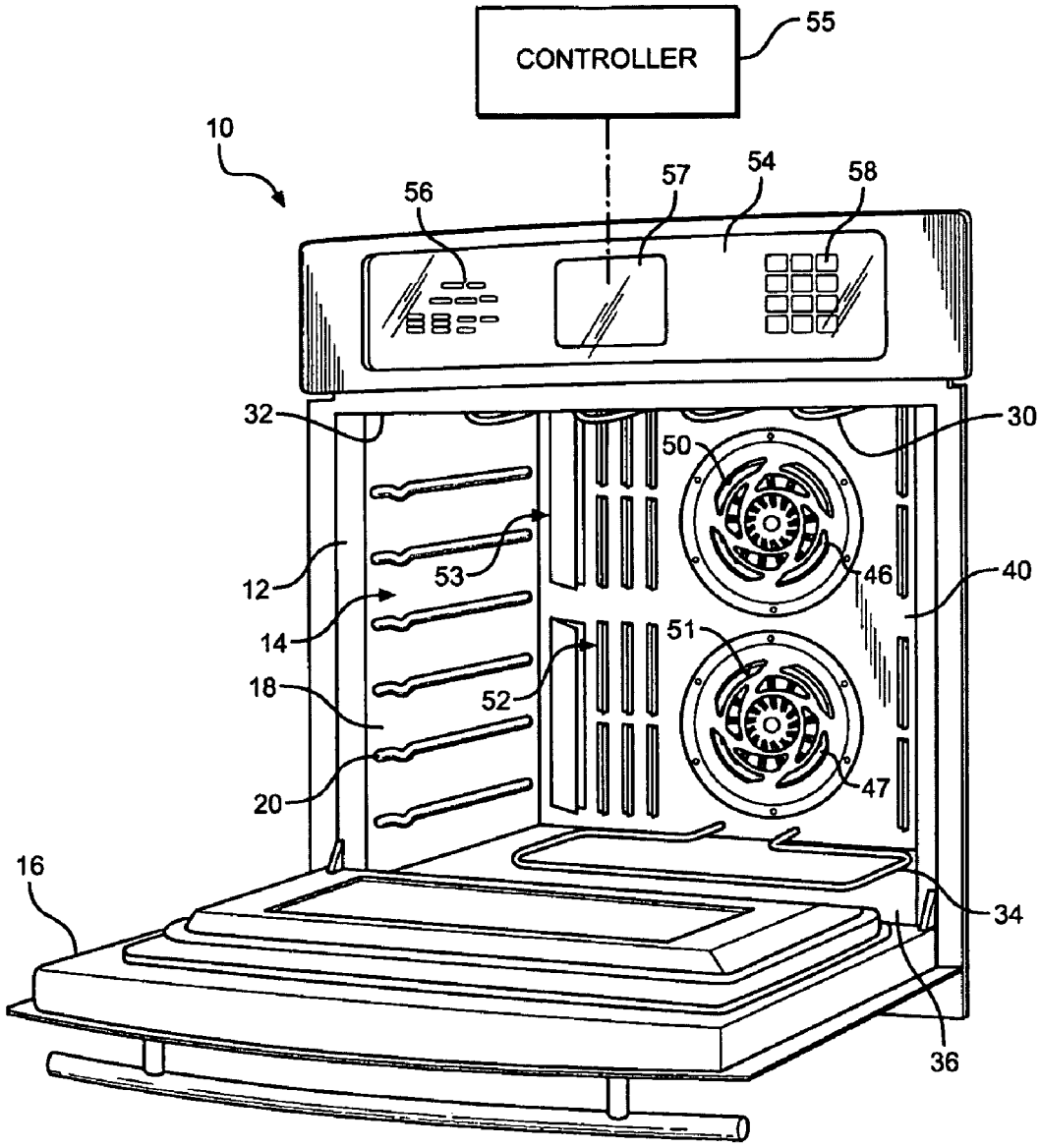
FIG. 1 is a perspective view of a combination cooking oven constructed in accordance with the present invention.

With initial reference to FIG. 1, a combination radiant heat and convection oven of the present invention is generally indicated at 10. In the preferred embodiment shown, oven 10 is a wall-mounted or built-in oven, and includes a cabinet 12 which forms an oven cavity 14. A door 16 is pivotally mounted to cabinet 12 for selectively closing oven 10 and sealing oven cavity 14. Oven cavity 14 includes opposing side walls 18 having a plurality of spaced rails 20 for supporting repositionable racks (not shown) in a manner known in the art.

In accordance with the present invention, oven 10 also includes an upper broil element 30 mounted adjacent an upper wall 32 of oven cavity 14 and a lower bake element 34 mounted adjacent a lower wall 36 of oven cavity 14. In a preferred embodiment of the invention, upper broil element is constituted by a 3600 watt resistive-type electric heating element, while lower bake element 34 is constituted by a 2800 watt resistive-type electric heating element. A convection cover 40 is adapted to be mounted over first and second motor driven fans 46 and 47 within oven cavity 14 as will be discussed more fully below. Fans 46 and 47 are constituted by multi-speed electric fans which can be continuously operated or pulsed as detailed below. In accordance with the most preferred embodiment of the invention, fans 46 and 47 are centrally mounted and vertically arranged within oven cavity 14, such that first and second fans 46 and 47 align with and positioned at respective first and second circular apertures 50 and 51 formed in convection cover 40. In the preferred embodiment, convection cover 40 also includes a first and second plurality of spaced angled louvered openings 52 and 53 on either side of first and second fans 46 and 47, with louvered openings 52 and 53 being adapted to distribute heated air evenly throughout oven cavity 14 as will be discussed in more detail below. A user interface 54 is arranged in communication with a controller 55 and provides a user with a means for controlling oven 10. Preferably, interface device 54 includes a plurality of mode or operation selectors 56, a display 57 and a control pad 58. In the embodiment shown, selectors 56 take the form of buttons, display 57 is constituted by a LCD screen and control pad 58 includes a number pad, although a wide range of programming arrangements could be employed.

Figure 2:
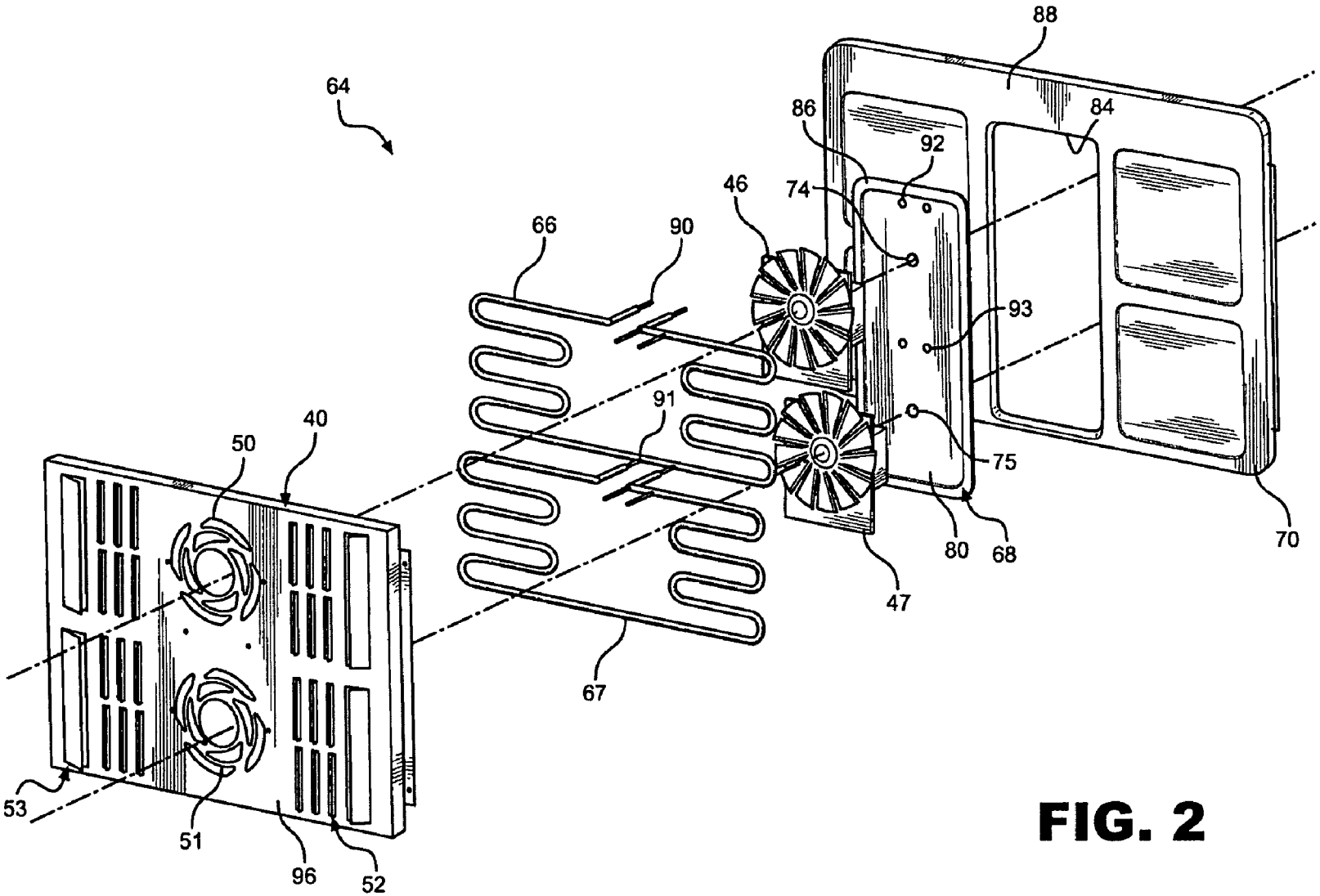
FIG. 2 is an exploded perspective view of a convection heating system employed in the oven of FIG. 1.

An overall convection heating system 64 utilized in connection with the present invention will now be discussed with reference to FIG. 2. In general, convection heating system 64 includes convection cover 40, a first upper convection heater 66, a second lower convection heater 67, first and second fans 46 and 47, a fan mounting panel 68 and a back panel 70. First and second fans 46 and 47 are mounted through respective apertures 74 and 75 to fan mounting panel 68. Fan mounting panel 68 includes a recessed main body portion 80 which nests within a cut-out portion 84 of back panel 70, and a peripheral edge portion 86 of fan mounting panel 68 abuts a front face portion 88 of back panel 70 about the periphery of cut-out portion 84. First and second convection heaters 66 and 67 are then positioned about first and second fans 46 and 47 respectively, with electric connector portions 90 and 91 of first and second convection heaters 66 and 67 fitting through pairs of openings 92 and 93 in fan mounting panel 68 respectively. In a preferred embodiment of the invention, both first and second convection heaters 66 and 67 are constituted by 3600 watt resistive-type electric heating elements. With convection cover 40 mounted to establish a back wall for oven cavity 14, back panel 70 is secured behind cabinet 12, whereby first and second convection heaters 66 and 67 are located behind convection cover 40 and first and second fans 46 and 47 fit within respective first and second apertures 50 and 51.

Although the invention is particularly directed to the structure of the overall cooking appliance, for the sake of completeness, the method by which a user can control heating operations of oven 10 will now be discussed. Controller 55 is in communication with user interface device 54 for controlling the operation of upper broil element 30, lower bake element 34, first and second convection heaters 66 and 67, and the first and second motor driven fans 46 and 47. Interface 54 allows a user to choose between a plurality of cooking modes, as well as a desired cooking set point temperature, depending on the desired outcome and type of food to be cooked. As will be detailed more fully below, the present invention preferably provides for at least a bake mode, a no preheat convection bake mode, a rapid preheat convection bake mode, a standard preheat convection bake mode and a convection roast mode. During operation, depending on their rotational directions, fans 46 and 47 can operate to draw in air from oven cavity 14 at apertures 50 and 51, direct the air radially outward across heaters 66 and 67, and output the heated air back to oven cavity 14 at the various louvered openings 52 and 53, with the louvered openings 52 angling the air flow towards side walls 18 and openings 53 defining enlarged distribution channels such that a high, reverse counter-flow can be established as evidenced more fully below. Certainly, convection ovens are known. Therefore, it is the particular construction as set forth above and operation of the overall heating system which is of concern to the invention. To this end, the function of the various cooking elements, i.e. broil element 30, bake element 32, first and second fans 46 and 47, and first and second convection heaters 66 and 67, for each of the above-cooking modes will now be discussed in detail, along with heating element priorities in the various cooking modes.

In connection with each of the cooking modes, it should be initially realized that controller 55 establishes a plurality of cooking stages during which both the first and second motor driven fans 46 and 47 are distinctly driven and each of the plurality of heating elements 30, 32, 66 and 67 is only sequentially activated based on a predetermined priority schedule which varies depending on a particular cooking selection by the user. In one preferred embodiment of the invention, preheat and postheat cooking are collectively realized through multiple stages of cooking. In each stage, each of the plurality of heating elements 30, 32, 66 and 67 is sequentially operated based on the predetermined priority schedule. More specifically, an overall duty time cycle is established for each stage and each of the plurality of heating elements 30, 32, 66 and 67 is operated for a portion of the overall time period such that the collective amount of operating time for all of the plurality of heating elements 30, 32, 66 and 67 does not exceed the duty cycle. In certain cases, the duty cycle can be repeated and any remaining time on the duty cycle, during which one of the plurality of heating elements 30, 32, 66 and 67 is not activated, merely constitutes a dwell time period. To more fully understand these operational aspects, the overall operation, with reference to three stage cooking operations and preferred duty cycles and priority schedules, will now be described for each of various cooking modes.

At this point it should be noted that, for any given cooking operation or mode selected by a user as discussed below, the oven cavity itself experiences preheat and postheat phases. That is, even if a user selects a cooking operation without preheat, i.e., the user intends to put the food to be cooked into oven cavity 14 without waiting for oven cavity 14 to be preheated, such as exemplified by the selection of a convection bake mode without preheat as discussed in detail hereinafter with particular reference to Table 2, oven cavity 14 itself still will experience a preheat phase. In any case, in accordance with the overall invention, each cooking operation is broken down into at least three stages, with each stage having a set duty cycle and with heating elements 30, 32, 66 and 67 being operated for a predetermined portion of the overall duty cycle. Basically, the established duty cycle sets an overall time period for each stage and heating elements 30, 32, 66 and 67 are sequentially activated for predetermined portions of the overall time period, with the collective time period of activation for all of heating elements 30, 32, 66 and 67 being less than or equal to the duty cycle. In the case that the cumulative activation times for heating elements 30, 32, 66 and 67 is less than the duty cycle, this simply reflects that additional dwell time is employed during which none of the heating elements 30, 32, 66 and 67 are activated. As heating elements 30, 32, 66 and 67 are only sequentially activated, i.e., no more than one of heating elements 30, 32, 66 and 67 will be on at any given time, the activation sequence is prioritized. The transition from one stage to the next is preferably based on predetermined temperature variations from a user establishing cooking set point, although the transitions could take place in a timed manner. In general, due to typically available power supplies and the fact that high wattage elements are employed for heating elements 30, 32, 66 and 67, the overall control to be described has been established such that the sequentially activated heating elements 30, 32, 66 and 67 are controlled in a synergistic manner to provide for optimal heating and effective cooking in the various modes.

As set forth on Table 1 below, during a bake mode, first motor driven fan 46 is actuated and rotates counter-clockwise at a low speed, while second motor driven fan 47 is rotated clockwise at a low speed. In a preferred embodiment, a low speed between 800-1200 rpm's is employed. More specifically, first and second fans 46 and 47 are pulsed throughout the bake mode. In the most preferred embodiment, fans 46 and 47 are repeatedly actuated for 30 seconds then deactivated for 30 seconds. It can also be seen that a duty cycle of 60 seconds has been established for the selected bake mode. In each of the three stages shown, broil element 30 has been assigned first priority, bake element 34 has been given second priority, second or lower convection heating element 67 has third priority and first or upper convection heating element 66 has fourth priority. More specifically, in the most preferred embodiment represented in this table, broil element 30 is initially activated for 10 seconds out of the overall 60 second duty cycle during the preheat phase. Thereafter, bake element 34 is activated for 10 seconds. Then, each of second and first convection heating elements 67 and 66 are activated, one at a time, for 25 seconds each. Concurrent with each of these activations, each of fans 46 and 47 are pulsed at low speeds as outlined above. In accordance with this bake mode, a transition between the first and second stages will occur at 70° F. from a user selected cook temperature, while the transition between the second and third stages occurs at 40° F. from the desired cook temperature. After the preheat phase, the priority order remains the same, but the activation times are altered as indicated.

TABLE 1

| BAKE MODE | | | | |
|---|---|---|---|---|
| | | | Preheat (sec) | Postheat (sec) |
| Duty Cycle | 60 | Broil | 10 | 3 |
| | | Upper convection | 25 | 10 |
| | | Lower convection | 25 | 27 |
| | | Bake | 10 | 20 |
| | | Stage 1 | Stage 2 | Stage 3 |
| Element Priority | | | | |
| Broil | | 1 | 1 | 1 |
| Upper convection | | 4 | 4 | 4 |
| Lower convection | | 3 | 3 | 3 |
| Bake | | 2 | 2 | 2 |
| Fan Operation | | | | |
| Upper fan (counterclockwise) | | low speed | low speed | low speed |
| Lower fan (clockwise) | | low speed | low speed | low speed |

Both fans pulse 30 sec on then 30 sec off during BAKE

Stage transitions from Stage 1 to Stage 2 at −70 from set point and transitions to Stage 3 at −40 from set point then remains in Stage 3 for remainder of on time.

Table 2 below will now be referenced in describing the operation of oven 10 during the no preheat convection bake mode of the present invention. During the no preheat convection bake mode, first motor driven fan 46 is actuated and rotates counter-clockwise at a high speed and second motor driven fan 47 is rotated clockwise at a high speed in each of the stages of operation. In the preferred embodiment, a high speed from 1600-2000 rpm's is employed. Both first and second fans 46 and 47 are continuously operated during the convection bake operation. Like the bake mode, the no preheat convection bake mode employs a shift from the first to the second stage at 70° F. below the set point or desired cooking temperature, and a shift from the second stage to the third stage at 40° F. below the set point temperature. During each stage of this mode, first convection heater 66 receives main priority, followed by second convection heater 67, bake element 34 and broil element 30. Unlike the bake mode, the convection bake mode with no preheat employs a duty cycle of 255 seconds. With these set priorities and duty cycle, first convection heater 66 is activated for just over 84 seconds, second convection heater 67 is activated for 114.75 seconds, bake element 34 for just over 33 seconds and broil element 30 for just under 23 seconds throughout preheat. At this point it should be noted that the reason for the exact times given is that controller 55 preferably starts with a preset duty cycle time, along with a percentage of operation of each of heating elements 30, 34, 66 and 67 for that time period. Therefore, in this case, first convection heater 66 is activated for 33% of the duty cycle, second convection heater 67 for 45%, bake element 34 for 13% and broil element 30 for 9%, hence the particular calculated times in preheat. After the preheat phase, the priority order remains the same, but the activation times are altered as indicated.

TABLE 2

| CONVECT BAKE (no preheat) | | | | |
|---|---|---|---|---|
| | | | Preheat (sec) | Postheat (sec) |
| Duty Cycle | 255 | Broil | 22.95 | 5.1 |
| | | Upper convect element | 84.15 | 63.75 |
| | | Lower convect element | 114.75 | 124.95 |
| | | Bake | 33.15 | 56.1 |
| | | Stage 1 | Stage 2 | Stage 3 |
| Element Priority | | | | |
| Broil | | 4 | 4 | 4 |
| Upper convect element | | 1 | 1 | 1 |
| Lower convect element | | 2 | 2 | 2 |
| Bake | | 3 | 3 | 3 |
| Fan Operation | | | | |
| Upper fan (counterclockwise) | | high speed | high speed | high speed |
| Lower fan (clockwise) | | high speed | high speed | high speed |

Both fans run continuously during convect bake.

Stage transitions from Stage 1 to Stage 2 at −70 from set point and transitions to Stage 3 at −40 from set point then remains in Stage 3 for remainder of on time.

Table 3 below will now be referenced in describing the operation of oven 10 during the rapid preheat convection bake mode of the present invention. During the rapid preheat convection bake mode, first motor driven fan 46 is actuated and rotates counter-clockwise at a low speed and second motor driven fan 47 is rotated clockwise at a low speed. Both first and second fans 46 and 47 are continuously operated during the convection bake operation. Again, the rapid preheat convection bake mode operates with preheat and postheat phases and at least three cooking stages, with a shift from the first to the second stage done at 70° F. below the set point temperature or desired cooking temperature, and a shift from the second stage to the third stage at 40° F. below the set point temperature. The first and second stages have the same element priority as the no preheat convection bake mode, while the second stage gives first priority to broil element 30, followed by first convection heater 66, second convection heater 67 and bake element 34. The preferred activation times for heating elements 30, 34, 66 and 67 are clearly set forth in the table below based on a 100 second duty cycle.

TABLE 3

| CONVECT BAKE (rapid preheat) | | | | |
|---|---|---|---|---|
| | | | Preheat (sec) | Postheat (sec) |
| Duty Cycle | 100 | Broil | 7 | 5 |
| | | Upper convect element | 35 | 30 |
| | | Lower convect element | 45 | 55 |
| | | Bake | 10 | 5 |

TABLE 3-continued

| CONVECT BAKE (rapid preheat) | | | |
|---|---|---|---|
| | Stage 1 | Stage 2 | Stage 3 |
| Element Priority | | | |
| Broil | 4 | 1 | 4 |
| Upper convect element | 1 | 2 | 1 |
| Lower convect element | 2 | 3 | 2 |
| Bake | 3 | 4 | 3 |
| Fan Operation | | | |
| Upper fan (counterclockwise) | low speed | low speed | low speed |
| Lower fan (clockwise) | low speed | low speed | low speed |

Both fans run continuously during convect bake.

Stage transitions from Stage 1 to Stage 2 at −70 from set point and transitions to Stage 3 at −40 from set point then remains in Stage 3 for remainder of on time.

Table 4 sets forth a preferred operation of oven 10 during the standard preheat convection bake mode of the present invention. During the standard preheat convection bake mode, first motor driven fan 46 is actuated and rotates counter-clockwise at a low speed and second motor driven fan 47 is rotated clockwise at a low speed. Both first and second fans 46 and 47 are continuously operated during the convection bake operation. Like the other modes set forth above, preheat and postheat phases exists, along with multiple stages having corresponding transitions. Although the activation times have been altered, the same duty cycle and stage priorities are preferably employed in the standard preheat convection bake mode as in the convection bake mode with rapid preheat as described above.

TABLE 4

| CONVECT BAKE (standard preheat) | | | | |
|---|---|---|---|---|
| | | | Preheat (sec) | Postheat (sec) |
| Duty Cycle | 100 | Broil | 7 | 7 |
| | | Upper convect element | 35 | 30 |
| | | Lower convect element | 40 | 55 |
| | | Bake | 6 | 5 |
| | | Stage 1 | Stage 2 | Stage 3 |
| Element Priority | | | | |
| Broil | | 4 | 1 | 4 |
| Upper convect element | | 1 | 2 | 1 |
| Lower convect element | | 2 | 3 | 2 |
| Bake | | 3 | 4 | 3 |
| Fan Operation | | | | |
| Upper fan (counterclockwise) | | low speed | low speed | low speed |
| Lower fan (clockwise) | | low speed | low speed | low speed |

Both fans run continuously during convect bake.

Stage transitions from Stage 1 to Stage 2 at −70 from set point and transitions to Stage 3 at −40 from set point then remains in Stage 3 for remainder of on time.

Finally, with reference to Table 5 below and the convection roast mode, first motor driven fan 46 is actuated and rotates counter-clockwise at a high speed and second motor driven fan 47 is rotated clockwise at a high speed. Both first and second fans 46 and 47 are continuously operated during the convection roast operation. A duty cycle of 100 seconds is employed for the various heating elements 30, 34, 66 and 67. Like the other convection modes discussed above, the convection roast mode includes three cooking stages, with a shift from the first to the second stage done at 70° F. below the set point temperature or desired cooking temperature, and a shift from the second stage to the third stage at 40° F. below the set point temperature. However, the priority stages differ from the previous convection modes. More specifically, in the first stage, second convection heater 67 is given priority, followed by the first convection heater 66, bake element 34, then broil element 30. In the second stage, second convection heater 67 again receives priority, followed by bake element 34, first convection heater 66 and broil element 30. In the third stage, first convection heater 66 receives priority, followed by second convection heater 67 and bake element 34 only. Broil element 30 is not utilized during the postheat phase such that, once oven cavity reaches its preheat temperature which, in a manner known in the art depends on the set temperature for the cooking operation, broil element 30 is not longer employed for post heating in the convection roast cooking mode.

TABLE 5

| CONVECT ROAST | | | | |
|---|---|---|---|---|
| | | | Preheat (sec) | Postheat (sec) |
| Duty Cycle | 100 | Broil | 25 | 0 |
| | | Upper convect element | 25 | 45 |
| | | Lower convect element | 25 | 45 |
| | | Bake | 10 | 10 |
| | | Stage 1 | Stage 2 | Stage 3 |
| Element Priority | | | | |
| Broil | | 4 | 4 | 0 |
| Upper convect element | | 2 | 3 | 1 |
| Lower convect element | | 1 | 1 | 2 |
| Bake | | 3 | 2 | 3 |
| Fan Operation | | | | |
| Upper fan (counterclockwise) | | high speed | high speed | high speed |
| Lower fan (clockwise) | | high speed | high speed | high speed |

Both fans run continuously during convect roast.

Stage transitions from Stage 1 to Stage 2 at −70 from set point and transitions to Stage 3 at −40 from set point then remains in Stage 3 for remainder of on time.

Based on the above, it should be apparent that the construction and operation of oven 10 makes possible the efficient and effective distribution of heated air during a variety of convection cooking modes. In the most preferred embodiment of the invention described above, two fans are employed, although additional fans could also be utilized. Arranging the fans centrally and vertically has been found to provide particular air distribution advantages in a typically sized domestic oven cavity, particularly when the fans are operated in opposite directions. In addition, the mounting configuration provides for ease of assembly, while also enhancing the ability to access the various convection components if servicing is needed. The establishment of the various stages and priority schedules for set duty cycles as set forth in accordance with the invention have been found to not only reduce required cook times but represent extremely efficient and effective control sequences for the types of cooking operations typically performed for the available modes.

Although described with reference to a preferred embodiment of the invention, it should be readily understood that various changes and/or modifications can be made to the invention without departing from the spirit thereof. For instance, although a wall mounted oven 10 is discussed, it should be understood that the invention can be employed in a free standing oven or range without departing from the invention. In addition, although bake element 34 is shown to be exposed within oven cavity 14, bake element 14 could be arranged below a false bottom in a manner known in the art. It should also be recognized that the dual vertical fan could also be employed with a common convection heating element extending about both of the upper and lower fans, between the back panel and the convection cover. Furthermore, although a combination radiant and convection system has been described, other cooking systems, such as a microwave system, could also be integrated into oven 10. Finally, although the embodiment described above employs temperature to determine stage transitions, preset time can also be utilized. In general, the invention is only intended to be limited by the scope of the following claims.

We claim:

1. A. cooking appliance comprising:

a cabinet defining an oven cavity:

a door attached to said cabinet for selectively exposing and sealing the oven cavity;

a broil element mounted to the cabinet for heating the oven cavity;

a bake element mounted to the cabinet for heating, the oven cavity;

a convection heating system including:

a convection cover including first and second vertically spaced apertures and first and second sets of spaced openings, said convection cover being mounted to the cabinet and defining a rear wall of the oven cavity;

a back panel including a cut-out portion said back panel being mounted to the cabinet behind the convection cover;

a first convection fan assembly positioned between the convection, cover and the back panel, and a first motor driven convection fan positioned at the first aperture;

a second convection fan assembly positioned between the convection cover and the back panel, and a second motor driven convection fan positioned at the second aperture such that the first and second motor driven convection fans are vertically spaced in the oven cavity;

a fan mounting panel, each of the first and second convection fans being directly mounted to the fan mounting panel, wherein said fan mounting panel is positioned between the convection cover and the back panel and projects into the cut-out portion; and at least one convection heater extending about at least, one of the first and second motor driven convection fans between the back panel and the convection cover; and a controller in communication with the user interface device for controlling the operation of the broil element, the bake element, the at least one convection heater, and the first and second convection fans.

2. The cooking appliance according to claim 1, wherein the first and second convection fans can rotate in opposite directions.

3. The cooking appliance of claim 2, wherein each of the first and second convection fans constitutes a multi-speed fan.

4. The cooking appliance according to claim 1, wherein the first and second apertures are centrally arranged in the oven cavity.

5. The cooking appliance according to claim 1, wherein the oven cavity constitutes a wall oven.

6. The cooking appliance according to claim 1, wherein the at least one convection heater is constituted by a resistive heating element including a pair of electrical connectors, said mounting panel being formed with openings, with the electrical connectors projecting through the openings.

7. The cooking appliance according to claim 1, wherein the fan mounting panel includes a peripheral edge portion and a recessed central body portion, said recessed central body portion being received in the cut-out portion and the peripheral edge portion abutting the back panel.

8. The cooking appliance according to claim 1, wherein the first and second sets of spaced openings in the convection cover constitute louvered openings.

9. The cooking appliance according to claim 8, further comprising: additional openings provided in the convection cover, wherein the additional openings are larger in size than the first and second sets of spaced openings.

10. The cooking appliance according to claim 9, wherein the additional openings constitute first and second sets of additional openings arranged outwardly of the first and second sets of spaced openings respectively.

11. The cooking appliance according to claim 10, wherein the first and second sets of additional openings constitutes additional louvered openings.

12. The cooking appliance according to claim 1, wherein the at least one convection heater extending about the at least one of the first and second motor driven fans includes a first convection heater extending about the first motor driven fan between the back panel and the convection cover and a second convection heater extending about the second motor driven fan between the back panel and the convection cover.

13. The cooking appliance according to claim 1, wherein the user interface enables a user to select between at least a bake mode, a no preheat convection bake mode, a rapid preheat convection bake mode, a preheat convection bake mode and a convection roast mode.

* * * * *